US008727146B2

(12) United States Patent
Radmall

(10) Patent No.: US 8,727,146 B2
(45) Date of Patent: May 20, 2014

(54) ADJUST AND LOCK MECHANISM

(75) Inventor: Paul Radmall, Benheim (NZ)

(73) Assignee: Reid Lifting Limited, Chepstow, Monmouthshire (GB)

( * ) Notice: Subject to any disclaimer, the term of this patent is extended or adjusted under 35 U.S.C. 154(b) by 1038 days.

(21) Appl. No.: 12/743,108

(22) PCT Filed: Nov. 17, 2008

(86) PCT No.: PCT/EP2008/065675
§ 371 (c)(1),
(2), (4) Date: Aug. 27, 2010

(87) PCT Pub. No.: WO2009/063091
PCT Pub. Date: May 22, 2009

(65) Prior Publication Data

US 2010/0319476 A1 Dec. 23, 2010

(30) Foreign Application Priority Data

Nov. 16, 2007 (GB) ..... 0722596.4

(51) Int. Cl.
*B66C 5/02* (2006.01)
*B66C 19/00* (2006.01)

(52) U.S. Cl.
USPC ..... 212/324; 70/223; 248/166; 212/271

(58) Field of Classification Search
USPC ..... 74/413, 414, 411.5, 422; 248/150, 165, 248/166, 440.1; 70/190, 191, 222, 223; 192/215, 224, 69.63; 188/265, 382; 212/324, 312, 271
See application file for complete search history.

(56) References Cited

U.S. PATENT DOCUMENTS

| | | | |
|---|---|---|---|
| 1,393,218 | A | 10/1921 | Herrbold |
| 1,931,655 | A | 10/1933 | Haseltine |
| 2,000,078 | A | 5/1935 | Haseltine |
| 2,493,242 | A | 1/1950 | Geer |
| 3,263,831 | A | 8/1966 | Francis |
| 4,334,480 | A | 6/1982 | Wallace |
| 4,527,680 | A | 7/1985 | Sato |

FOREIGN PATENT DOCUMENTS

| | | |
|---|---|---|
| BE | 463 939 | 4/1946 |
| DE | 15 366 | 9/1881 |
| FR | 2 754 552 | 4/1998 |
| GB | 1 139 559 | 1/1969 |
| GB | 2 118 025 | 10/1983 |
| NL | 8700771 | 11/1988 |
| WO | WO 00/76901 | 12/2000 |

OTHER PUBLICATIONS

European Office Action for European application 08 848 606.3 mailed May 10, 2012.

*Primary Examiner* — Sang Kim
*Assistant Examiner* — Juan Campos, Jr.
(74) *Attorney, Agent, or Firm* — Merchant & Gould P.C.

(57) ABSTRACT

An adjust and lock mechanism includes a drive gear (16) rotatably mounted on a frame and adapted to engage a drive track (15) on a member (13) to allow adjustment between the frame (1) and the member by rotation of the drive gear, the drive gear being mounted on a drive spindle (17) that can move axially relative to the drive gear and which is normally spring loaded (34) into locking engagement with the frame and can be moved axially to disengage the locking engagement and allow the spindle to be rotated to operate the drive gear. A locking engagement is provided by a dog gear at one end of the spindle. A lock release button (32) and hand wheel (18) to rotate the drive gear are located adjacent one another for joint operation. A gear train connects the hand wheel to the drive gear.

13 Claims, 5 Drawing Sheets

ADJUST AND LOCK MECHANISM

This application is a National Stage Application of PCT/EP2008/065675, filed 17 Nov. 2008, which claims benefit of Serial No. 0722596.4, filed 16 Nov. 2007 in Great Britain and which applications are incorporated herein by reference. To the extent appropriate, a claim of priority is made to each of the above disclosed applications.

TECHNICAL FIELD

This invention relates to an adjust and lock mechanism suitable for adjusting a moveable member such as an adjustable member of a gantry.

DISCLOSURE OF THE INVENTION

According to one aspect, the invention comprises an adjust and lock mechanism comprising a drive gear rotatably mounted in a frame and adapted to engage a drive track in an adjustable member that is to be adjusted relative to the frame by rotation of the drive gear, the drive gear being mounted on a drive spindle that can move axially relative to the drive gear and which is normally spring loaded into locking engagement with the frame and can be moved axially to disengage the locking engagement and allow the spindle to be rotated to operate the drive gear.

In one embodiment, the locking engagement is provided by a brake, such as a dog gear, and said axial movement is provided by mounting the drive gear on a sleeve in which the spindle slides. A lock release button on one end of the spindle allows it to be operated by depression, and the brake at the opposite end of the spindle disengages to allow the drive gear to be rotated. A hand wheel mounted on the spindle adjacent to the lock release button serves to rotate the drive gear to adjust the adjustable member. The lock release button is then released to allow the brake to re-engage and lock the adjustable member in its new position. The proximity of the hand wheel and lock release button facilities joint operation. Also the spring loading of the lock release button makes it fail-safe if released accidentally.

The adjust and lock mechanism may incorporate a gear train to improve the mechanical advantage of the hand wheel in operating the drive gear. The drive track in the adjustable member may comprise a drive chain secured in place to move with the adjustable member upon rotation of the drive gear. The drive track is preferably received in a channel in the adjustable member.

In one embodiment of the invention, the adjust and lock mechanism is mounted on a frame comprising front and back plates with the drive gear located between them and the hand wheel and lock release button accessible outboard of one of the plates. The plates may serve to connect a pair of splayed legs which extend downwards therefrom to form a base frame. Wheels may be provided at the lower ends to make the base frame mobile. The adjustable member is received between the plates to extend upwards from them and may be guided by support wheels either side to resist movement laterally of the drive gear and spindle.

According to another aspect, the invention comprises an adjust and lock mechanism comprising a drive wheel mounted on a drive spindle that can move axially relative to the drive wheel and which is normally spring loaded into locking engagement with a stop and can be moved axially to disengage the locking engagement and allow the spindle to be rotated to operate the drive wheel, a manually operable lock release member mounted on the spindle to move the spindle axially when operated, and a manually rotatable adjust member mounted on the spindle adjacent the lock release member so as to facilitate operation of both jointly.

According to yet another aspect, the invention comprises an adjustment mechanism comprising a drive gear rotatably mounted on a frame and adapted to engage a drive track in the form of a chain mounted on a member so as to allow adjustment between the frame and member by rotation of the drive gear.

DESCRIPTION OF THE DRAWINGS

The invention will now be described by way of example with reference to the accompanying drawings in which.

EMBODIMENTS OF THE INVENTION

Figure 1:
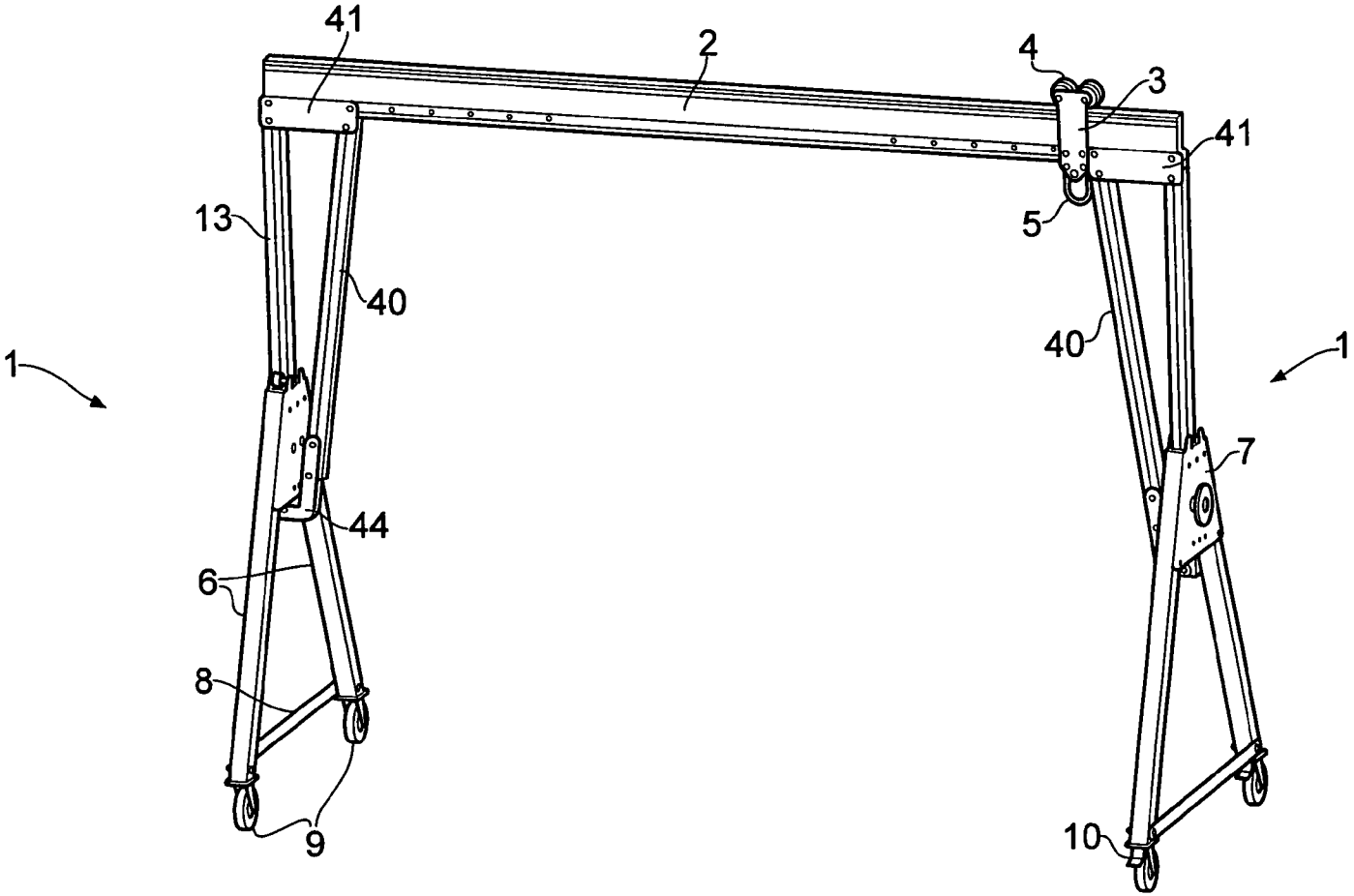
FIG. 1 shows a gantry crane fitted with an adjust and lock mechanism according to the invention.
Figure 2:
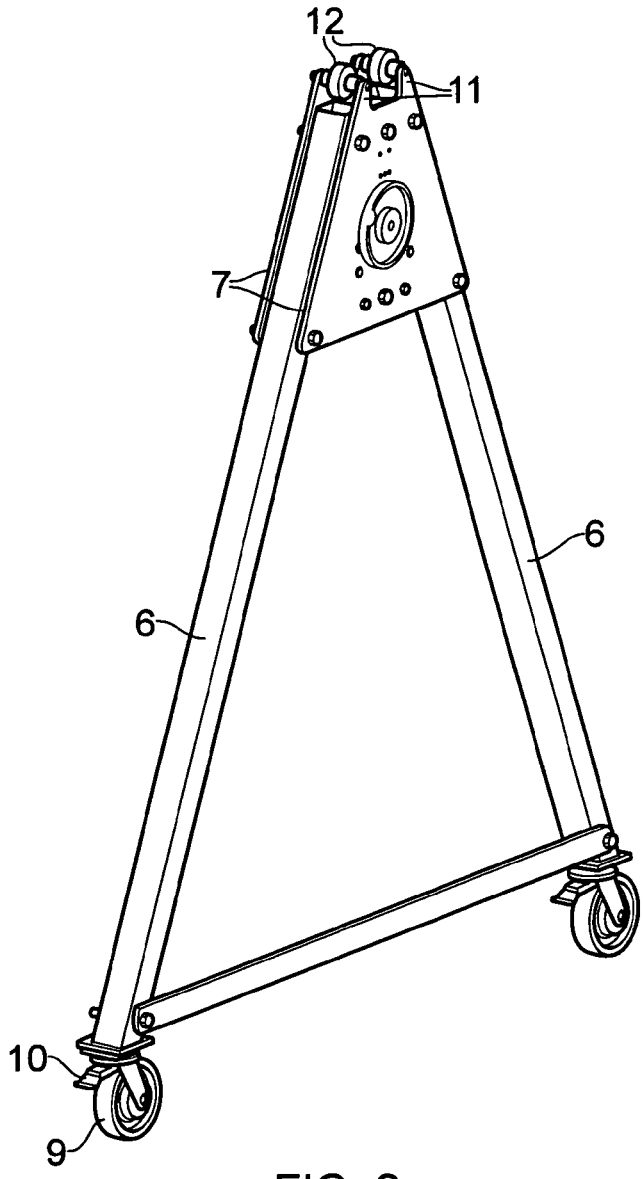
FIG. 2 is a more detailed view of a side frame of the gantry of FIG. 1.

The gantry shown in FIG. 1 comprises two upright side frames 1 connected by a horizontal beam 2 supporting a beam trolley 3 that runs along the beam on wheels 4 and has a lifting eye 5. The side frames 1 each comprise a pair of legs 6 joined at their top by a pair of connecting plates 7 which diverge downwards and are connected at their bottom by a tie bar 8. A wheel 9 is connected to the bottom of each leg 6 and is provided with a brake 10. The legs 6 are tubular with a rectangular section and their side faces abut the plates 7 either side.

The plates 7 are of a generally triangular shape to match the profile of the diverging legs 6 and each have a pair of upwardly projecting lugs 11 at their upper end to form mounting points for a pair of guide wheels 12 located between respective pairs of lugs 11 either side of a central vertical gap between the two plates. This gap is designed to receive an upright adjustable support 13, the top of which is connected to one end of the horizontal beam 2. The support 13 is a tubular member with a substantially rectangular section and has channels 14 formed longitudinally in opposite sides. A roller link chain 15 is fitted in one of these channels for engagement by a drive gear 16 to determine the vertical position of the support 13. A second pair of wheels 12 is mounted between the plates 7 below the drive gear 16 to engage and support the sides of the support 13.

Figure 3:
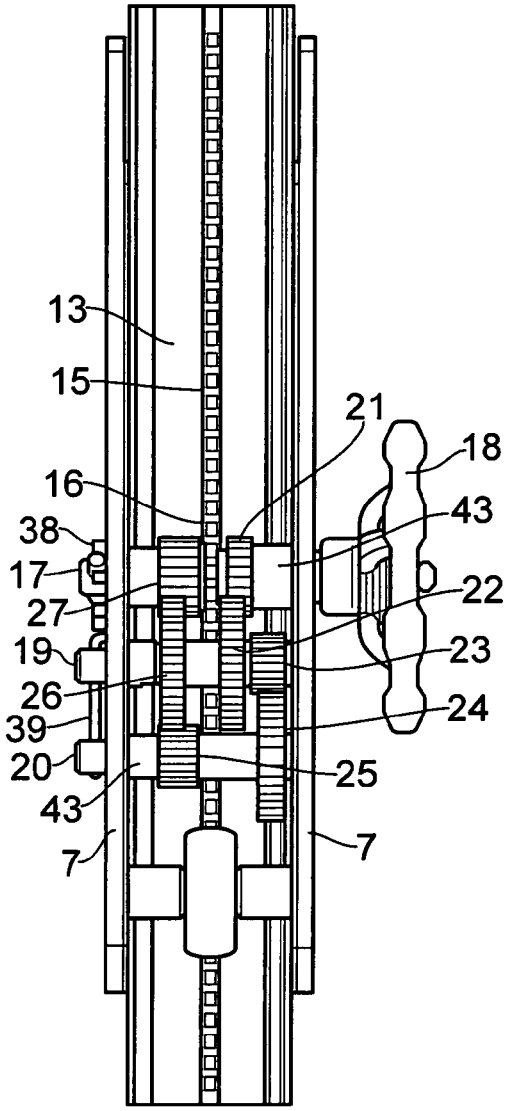
FIG. 3 is a side elevation of the adjust and lock mechanism of FIG. 1.
Figure 4:
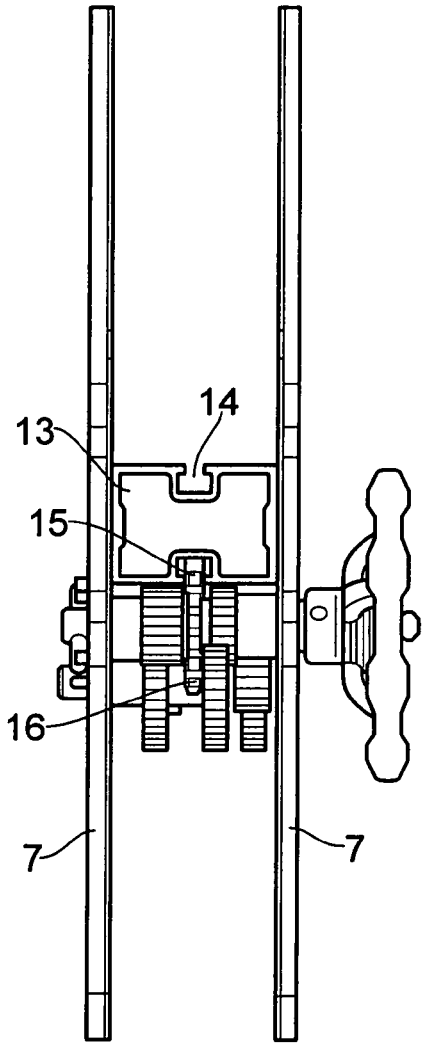
FIG. 4 is a top view of the adjust and lock mechanism of FIG. 3.
Figure 5:
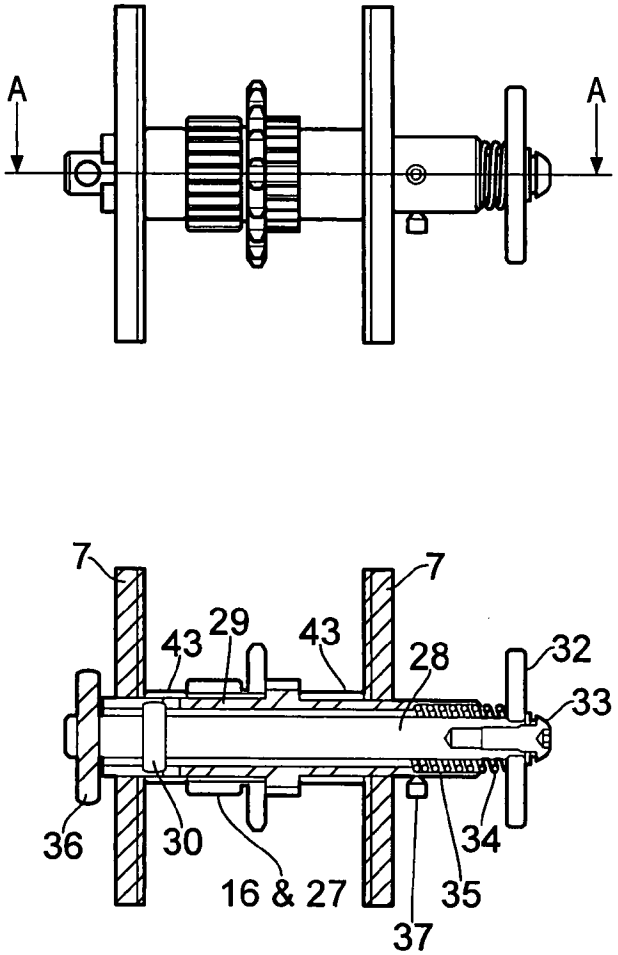
FIG. 5 is a section through the drive gear and spindle of the adjust and lock mechanism of FIG. 1.

As shown more clearly in FIGS. 3 to 5, the drive gear 16 is mounted on a drive spindle 17 between the two plates 7. The spindle 17 rotates in plain bearings in the plates 7 and a hand wheel 18 is mounted on the spindle 17 outboard of the outer plate 7 so as to be accessible for operation by a user to drive the drive gear 16. Grub screws 37 fasten the hand wheel 18 to the spindle 17. However, the hand wheel 18 drives the gear 16 via a drive train mounted between the plates 7 on the spindle 17 and two lay spindles 19 and 20. The drive train comprises an input gear 21 that is fixedly mounted on the spindle 17 and which meshes with a larger gear 22 of a double gear rotatably mounted on the lay spindle 19. A smaller gear 23 of the double gear meshes with a larger gear 24 of a double gear rotatably mounted on the second lay spindle 20, and a smaller gear 25 meshes with a third gear 26 rotatably mounted on the lay spindle 19 and substantially the same diameter as the gear 22 on the same spindle. The gear 26 meshes with a smaller gear 27 that is integral with the drive gear 16 as a double gear rotatably mounted on the spindle 17. Thus a drive train comprises seven gears with ratios such as to generate a mechanical advantage for the hand wheel 18 in rotating the drive gear 16 so as to move the chain 15 and support 13 vertically.

Figure 6:
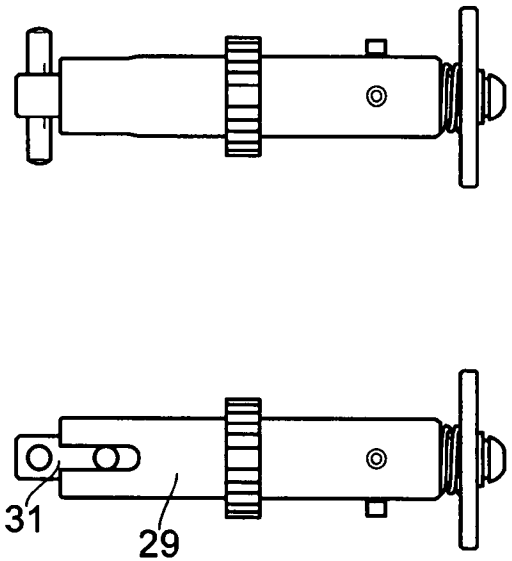
FIG. 6 is a side elevation of the spindle.

As shown more clearly in FIGS. 5 and 6, the spindle 17 comprises a square section rod 28 with a cylindrical sleeve 29 as a close fit over it. A pin 30 extends laterally through the rod 28 and projects either end to engage a pair of longitudinal slots 31 in the sleeve 29 so as to key the rod and sleeve together for rotation but to allow the rod to move axially within the sleeve 29. A disc 32 is connected by a screw 33 to one end of the rod 28 extending from the sleeve 29, and compresses a helical spring 34 that is received within a counterbore 35 in the open end of the sleeve 29 around the rod 28. The spring 34 serves to urge the rod 28 outwardly of the sleeve 29 until the pin 30 engages the bases of the slots 31. The end of the rod 28 opposite the disc 32 also extends from the sleeve 29 and is fitted with a second pin 36 that extends laterally in alignment with the slots 31 (although this is optional as the pin 36 does not need to engage the slots 31).

In use, the spindle 17 is installed with the disc 32 and grease points 37 outboard of the one plate 7, and with the second pin 36 outboard of the other plate 7. The outer face of this other plate 7 is provided with a series of projections 38 spaced around the end of the spindle so as to form spaces therebetween in which the projecting ends of the pin 36 can engage in the manner of a dog gear. Thus the spring 34 normally serves to urge the rod 28 axially so as to engage the dog gear, which serves to prevent rotation of the spindle 17. The dog gear 36, 38 therefore acts as a brake to prevent rotation of the spindle 17 until the disc 32 is depressed to disengage the dog gear 36, 38. Once the pin 36 is clear of the projections 38, the spindle is free to rotate. When the brake is applied, the downwards load of the supports 13 and horizontal beam 2 and any load carried by it, is transferred via the chain 15, drive gear 16, and spindle 17 to the dog gear brake 36, 38. When the brake is released by depressing the disc 32, the downwards load is applied through the gear train to the hand wheel 18, but the mechanical advantage of the gear train reduces the torque on the hand wheel so that it can be managed by a user. The fact that the disc 32 to operate the brake, and the hand wheel 18 to adjust the height of the beam 2 are located together on the same spindle serves to make joint use very easy.

It will be appreciated from FIGS. 3 to 5 that a number of gear spacers 43 are provided on the spindles 17, 19, 20 to keep the gear train aligned. The lay spindles 19, 20 are both fixed against rotation by a pin 39 that engages the ends of both. The plates 7 are provided with appropriate openings for the spindles, and these are duplicated in a symmetrical manner to avoid handedness of the assembly.

In order to increase lateral stability of the gantry, a strut member 40 is provided between the beam 2 and each side frame 1. The strut 40 comprises a tubular member similar to the support 13 and is connected at its lower end to the lower end of the support 13 where it projects below the plates 7. This connection 44 then limits the extent to which the support 13 and beam 2 can be raised vertically. The upper end of the strut 40 is connected to the beam 2 inboard of the support 13 via connection plates 41 either side. It will be appreciated that when the supports 13 and struts 40 are disconnected from the beam 2, the side frames 1 can be readily folded into a compact assembly for transport.

Figure 7:
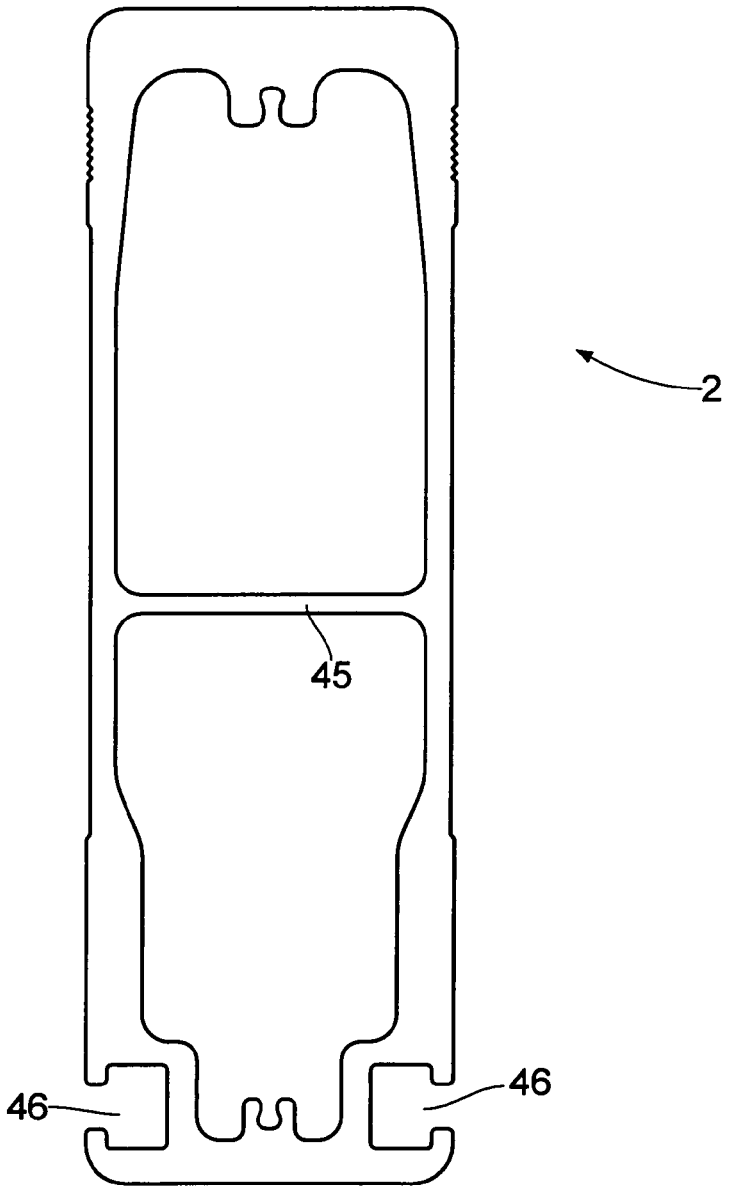
FIG. 7 is a cross-section of the horizontal beam of the gantry in FIG. 1.

The beam 2 preferably has a section as shown in FIG. 7 with a substantially rectangular section which is used in the upright mode. The beam is a tubular extrusion and is formed with an internal lateral strengthening wall 45. The side walls of the beam in the central region are of reduced thickness to reduce weight. The walls of the beam top and bottom are of increased thickness to increase strength and to accommodate channels 46 at the bottom, opening outwards onto both sides. These channels 46 are provided to accommodate equipment such as electrical harnesses or means to drive the beam trolley. For example, the channel might accommodate a chain with which a drive gear on a trolley engages in the manner of the drive gear 16 used for vertical adjustment in FIGS. 1 to 6. The drive gear might engage a roller chain mounted in one slot 46, and a power pick-up for an electric motor drive of the drive gear might engage a power pick-up rail mounted in the opposite slot 46.

In another embodiment, a beam trolley may be connected to a chain in the manner of a continuous loop and engage gears at either end of the beam, one of which is driven.

In yet another embodiment of the invention, the adjust and lock mechanism shown in FIGS. 1 to 6 for vertical adjustment of the upright supports 13, is used to control the position of the beam trolley 3, the mechanism being incorporated into the trolley with the drive gear 16 in engagement with a roller link chain fitted in a channel 46.

It will be appreciated that the provision of a chain to form a gear track is a simple and effective manufacturing step, which allows suitable hard wearing material to be used for the track in a member which may be composed of softer material, such as extruded aluminium.

The invention claimed is:

1. An adjust and lock mechanism comprising a drive gear rotatably mounted on a frame and adapted to engage a drive track on a member to allow adjustment between the frame and the member by rotation of the drive gear, a drive spindle having spring loading and on which the drive gear is mounted, the drive spindle being movable axially relative to the drive gear into locking engagement with the frame to prevent rotation, and an unlocking control operable to move the drive spindle axially against the spring loading to disengage the locking engagement and allow the spindle to be rotated to operate the drive gear while the unlocking control is held operated, the spring loading automatically returning the drive spindle to locking engagement with the frame when the unlocking control is released.

2. A mechanism as claimed in claim 1 in which the locking engagement is provided by a radial projection on the spindle which is engageable with a stop and is disengageable from the stop by axial movement of the spindle.

3. A mechanism as claimed in claim 1 in which the drive gear is fixedly mounted on a sleeve within which the spindle is free to move axially and to rotate.

4. A mechanism as claimed in claim 1, wherein the unlocking control is accessible for manual operation to move the spindle axially against the spring loading.

5. A mechanism as claimed in claim 4 in which the unlocking control is located at one end of the spindle, and the locking engagement with the frame is located at the opposite end of the spindle.

6. A mechanism as claimed in claim 4 further comprising an adjustment manual control that is accessible for manual operation to rotate the spindle and located adjacent to the unlocking control for combined operation.

7. A mechanism as claimed in claim 1 which includes a gear train to transfer rotation of the spindle to the drive gear.

8. A mechanism as claimed in claim 1, in which the member is mounted to be moveable relative to the frame.

9. A mechanism as claimed in claim 8 in which the frame comprises a mobile unit and the member comprises a track along which the mobile unit can be moved.

10. A mechanism as claimed in claim 1, wherein the member is a vertically adjustable upright member and wherein the frame comprises part of a framework supporting a vertically adjustable upright member.

11. A mechanism as claimed in claim 1 in which the drive track comprises a chain secured in place on the member for engagement by the drive gear.

12. A mechanism as claimed in claim 11 in which the chain is mounted in a channel in the member.

13. A gantry comprising side frames supporting a horizontal beam and incorporating the mechanism as claimed in claim 1.

* * * * *